United States Patent [19]

Iiyama et al.

[11] 4,345,966

[45] Aug. 24, 1982

[54] AUTOMATIC TAPE APPLICATOR

[76] Inventors: Shigeru Iiyama, No. 13-5, Kamisoshigaya 5-chome, Setagaya-ku, Tokyo; Sinzi Otsu, No. 13-14, Kamiaoki-nishi 2-chome, Kawaguchi-shi, Saitama-ken; Akio Ooyachi, No. 2292 Hachijo, Yashio-shi, Saitama-ken, all of Japan

[21] Appl. No.: 240,092

[22] Filed: Mar. 3, 1981

[30] Foreign Application Priority Data

Mar. 19, 1980 [JP] Japan ..... 55-36817[U]

[51] Int. Cl.[3] ..... B32B 31/00; B44C 7/00

[52] U.S. Cl. ..... 156/523; 156/577

[58] Field of Search ..... 156/522, 523, 574, 577, 156/579

[56] References Cited

U.S. PATENT DOCUMENTS

| | | | |
|---|---|---|---|
| 3,306,806 | 2/1967 | Seropian | 156/523 |
| 3,725,182 | 4/1973 | Regan | 156/577 |
| 4,097,328 | 6/1978 | Urushizaki | 156/523 |

*Primary Examiner*—Caleb Weston

*Attorney, Agent, or Firm*—Brumbaugh, Graves, Donohue & Raymond

[57] ABSTRACT

A tape applicator to be used for automatically sticking an adhesive tape onto an object which has two overlapped sheets of papers, for example, a flap of an envelope or wrapped end of wrapping paper, etc. and also for automatically cutting the adhesive tape in a desired length after the object has been stuck by the adhesive tape, without need for the user to directly touch the adhesive tape. The tape applicator of the present invention has the advantages of increasing the tape cutting force and of preventing the idle rotation of the rolled tape, and therefor, it is very excellent in reliability of continuous operation thereof.

3 Claims, 7 Drawing Figures

AUTOMATIC TAPE APPLICATOR

This invention relates to a tape applicator to be used for automatically sticking an adhesive tape onto an object which has two overlapped sheets of papers, for example, a flap of an envelope or wrapped end of wrapping paper, etc. and also for automatically cutting the adhesive tape in a desired length after the object has been stuck by the adhesive tape, without need for the user to directly touch the adhesive tape.

Heretofore, in sticking adhesive tape onto an object, the conventional manner has been for the user to firstly pinch the tape end between his finger tips and pull the tape off a tape roll held on a tape stand or a tape holder to a length substantially identical to the length of the object to be stuck with the adhesive tape, then to cut the adhesive tape with a saw-toothed cutter, and finally to apply the adhesive tape cut in the desired length onto the object and to stick the tape onto the object by pressing the tape surface.

In this conventional manner, the user encounters several troubles: the adhesiveness of the tape is weakened by the adhesion of dust or thumbmarks on the adhesive face of the tape; the tape end is liable to be become reattached to the outermost face of the rolled tape, and the length of the cut tape does not always correspond to the length of the object to be adhered and thus the appearance of the adhered object is spoiled.

In order to eliminate these troubles, an automatic tape applicator has been developed as disclosed in the Japanese laid-open U.M. publication No. 53-124285. However, in this tape applicator, since a disk for supporting a cutter blade is adapted to be driven by a pivotable pusher through a mechanism of a slot radially formed on the disk and a pin of the pusher slidably fitted into the slot of the disk, the torque for rotating the disk is minimized when the pin of the pusher nears the rotational axis of the disk, and therefore, the cutting force of the cutting blade is extremely reduced. Furthermore, since the pusher is pivoted on one end of a casing, the arc movement of a tape push roller provided on the fore-end of the pusher is liable to tear off the adhered tape end. Further, since the rolled tape is loosely supported on the pusher, the rolled tape is liable to be idly rotated by the shock of a spring for returning the pusher to its initial position and thus, the idle rotation of the rolled tape sometimes makes continuous operation of the tape applicator impossible.

It is, therefore, an object of the present invention to provide an automatic tape applicator eliminating the foregoing disadvantages of the prior art.

The object and advantages of the present invention will be apparent from the following description and the accompanying drawings.

Figure 1:
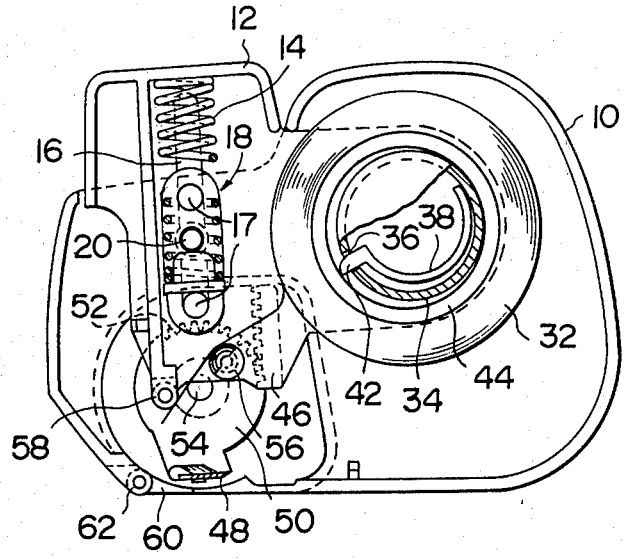
FIG. 1 is a cross-sectional side view showing the tape applicator of the present invention in its non-used condition.
Figure 2:
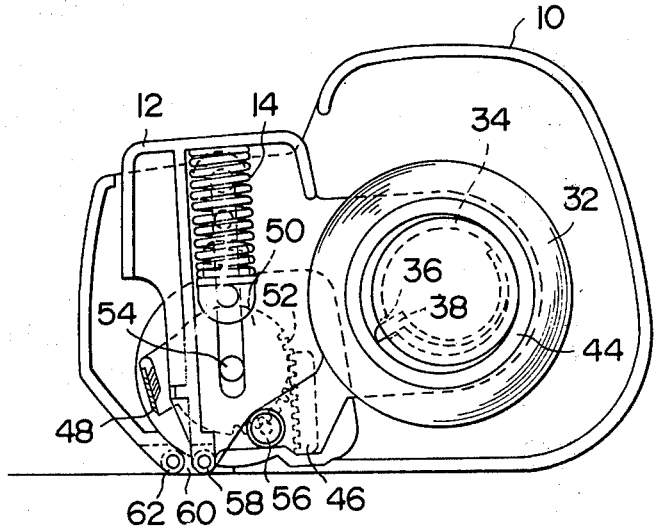
FIG. 2 is a cross-sectional side view showing the tape applicator of the present invention in its used condition.
Figure 3:
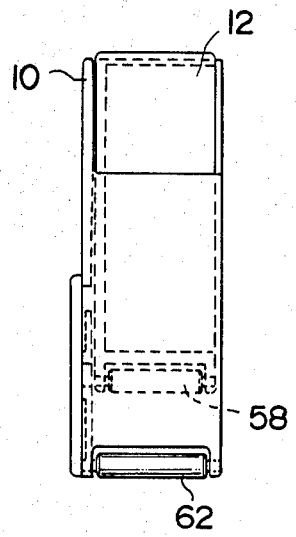
FIG. 3 is an elevational view of the tape applicator of the present invention.

As shown in FIGS. 1 through 3, a pusher 12 is so mounted in a space of a casing 10 that the pusher 12 is slidable relative to the casing 10. The pusher 12 is so biased that it is always upwardly pressed by a spring 14 positioned between the pusher 12 and a stay 18 in a manner hereinafter explained in detail. The side wall of the pusher 12 is formed with a guide slot 16 into which two guide studs 17 integrally formed with the casing 10 are received. Thus, the pusher 12 is slidably mounted within the casing 10 so that the pusher 12 can reciprocally move relative to the casing 10.

Figure 4:
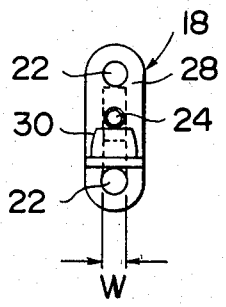
FIG. 4 and FIG. 5 are respectively an elevational view and a cross-sectional side view of the stay used in the present tape applicator.
Figure 5:
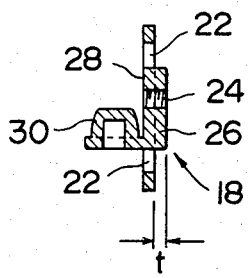

The stay 18 as shown in FIGS. 4 and 5 is mounted on the guide studs 17 by inserting the guide studs 17 into respective apertures 22 formed in the stay. The stay is rigidly fastened to the casing 10 by a screw 20. In the stay 18 shown in detail in FIGS. 4 and 5, the numerals 22 are apertures through which the guide studs of the casing 10 pass, the numeral 24 is an aperture for the fastening screw 20, the numeral 26 is a projected portion which is fitted into the guide slot 16 of the pusher 12 and has a width "W" slightly smaller than that of the guide slot 16 and a thickness "t" slightly larger than that of the side wall of the pusher 12 so that the pusher 12 is freely reciprocatable between the side wall of the casing 10 and the stay 18 in a condition that the fastening screw 20 is rigidly fastened to the casing 10, the numeral 28 is a flange for slidably holding the inner surface of the side wall of the pusher 12, and the numeral 30 is a projection for holding the one end of the spring 14. Such structure for mounting the pusher 12 to the casing 10 through the stay 18 and the spring 14 assures that the pusher 12 can be smoothly moved downwardly against the spring force when it is pushed by the user's finger and can be smoothly moved upwardly by the spring force when the user removes his finger from the pusher 12.

Figure 6:
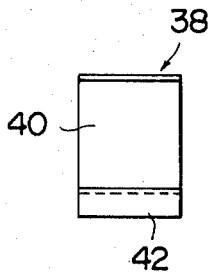
FIG. 6 and FIG. 7 are respectively an elevational view and a side view of the semi-circular spring for preventing idle rotation of the rolled tape.
Figure 7:
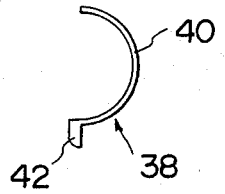

The pusher 12 is provided with a cylindrical tape supporter 34 for supporting a rolled adhesive tape 32. The cylindrical tape supporter 34 is integrally formed with the pusher 12. A slot 36 is formed in the cylindrical wall of the tape supporter 34. A semicircular spring 38 for preventing idle rotation of the rolled tape is so fitted into the cylindrical space of the tape supporter 34 that the nose 42 of the spring 38 is slightly projected from the cylindrical outer surface of the tape supporter 34. The configuration of the semicircular spring 38 is shown in FIGS. 6 and 7 in detail. Owing to the fact that the radius of curvature of the circular portion 40 of the spring 38 is formed slightly larger than that of the cylindrical space of the tape supporter 34, the spring 38 is held in the cylindrical space of the supporter 34 in elastically compressed condition. When the rolled tape 32 is mounted on the tape supporter 34, an inner surface of a core 44 of the rolled tape 32 contacts with the nose 42 of the semi-circular spring 38 and pushes the nose 42 inwardly and thus, the idle rotation of the rolled tape 32 is prevented by the semi-circular spring 38.

A rack 46 is integrally formed with the pusher 12 in the lower portion thereof. The rack 46 meshes with the teeth 52 of the pinion or disk 50 which is provided with a cutter blade 48 on the periphery of the disk 50. The disk 50 is rotated around a shaft 54 integrally formed with the casing 10 in a clockwise direction when the pusher 12 is pushed downwardly and is rotated in a counter-clockwise direction when the pusher 12 is moved upwardly.

A tape support roller 56 is arranged at lower portion of the pusher 12. The tape support roller 56 is so constructed that the tape end torn off from the rolled tape 32 is always guided exactly toward the underside of a tape deflecting roller 58 without twist or sagging thereof.

Since the outer surface of the tape support roller 56 is adapted to contact with the adhesive side of the tape, if the outer surface of the roller 56 is a smooth cylinder, the tape will adhere hard to the roller 56 and therefore, the tape will not be fed smoothly. According to the present invention, the tape support roller 56 is formed of a closely wound wire coil, therefore, the adhesive side of the tape is adhered intermittently only to the top of the coiled roll and thus, it enables smooth and light feed of the tape.

Further, at the lowermost portion of the pusher 12, a tape deflection roller 58 is provided. The tape deflection roller 58 is constructed to deflect the tape end downwardly in order to project the tape end from a window 60 for a tape passage formed in the bottom of the casing 10.

A tape press roller 62 is provided in the front side edge of the window 60 (left hand edge in FIG. 1). The tape press roller 62 is intended to press the non-adhesive side face of the tape in order to tightly adhere the tape onto the object.

Operation of the tape applicator of the present invention will be hereinafter clearly explained.

Firstly, the rolled tape 32 has to be mounted onto the tape supporter 34. Prior to the mounting of the rolled tape, it is necessary to tear off the tape end from the rolled tape in such length that the tape end can be positioned under the tape deflection roller 58. When the tape core 44 is mouhted onto the tape supporter 34, the nose 42 of the semi-circular spring 38 is pushed inwardly by the inner surface of the tape core 44. Thus, the rolled tape 32 is mounted on the tape supporter 34 so as not to idly rotate even when shock is applied to the tape applicator during operation thereof.

Then, the tape end has to be positioned on the underside of the tape deflection roller 58. During this positioning operation it is preferable to lightly adhere the adhesive side of the tape onto the coiled roller or support roller 56.

Thus, all setting operations of the tape in the tape applicator are completed.

In order to stick the adhesive tape onto the surface of the object, firstly the tape applicator of the present invention has to be placed on the object so that the tape press roller 62 is positioned onto one end of the object to be stuck. Then, by pushing the pusher 12 downwardly, the rack 46 is also moved donwardly and thus the pinion or the disk 50 is rotated in clockwise direction from the position shown in FIG. 1 to the position shown in FIG. 2. Due to the downward movement of the pusher 12, the tape end positioned under the deflection roller 58 is forwarded toward the window 60. The downward movement of the pusher 12 is stopped when the deflection roller 58 contacts to the surface of the object to be stuck.

As soon as the deflection roller 58 contacts the surface of the object, the adhesive tape end interposed between the roller 58 and the surface of the object is stuck onto the surface of the object. Therefore, the adhesive tape is stuck onto the object by moving the tape applicator along the object, keeping the pusher 12 pushed condition. Since the tape is pressed not only by the deflection roller 58 but by the press roller 62, the tape is tightly stuck onto the object.

In the position where the tape applicator is moved to the other end of the object, when the pressing force applied to the pusher 12 is released, the pusher 12 is upwardly returned to the initial position by the force of spring 14. This upward movement of the pusher 12 and therefore of the rack 46 causes rotation of the pinion or the disk 50 in counter clockwise direction. Thus, the cutter blade 48 mounted on the disk 50 passes to a slightly lower position from the deflection roller 58 being in upward motion and sharply cuts the tape tensioned between the object and the support roller 56.

When the tape is cut by the blade 48, the tape end stuck on the object usually remains in non-stuck condition. However, such a non-stuck tape end is completedly stuck onto the object by passing the press roller 62 over the tape surface.

The advantages of the tape applicator of the present invention are as follows:

(1) Since the disk 50 mounting the cutter blade 48 is driven by the rack 46, strong cutting force is obtained as compared with the tape applicator disclosed in the Japanese laid-open U.M. publication No. 53-124285, (2) Since the rolled tape 32 is held on the tape supporter 34 so as not to idly rotate by the semi-circular spring 38, the tape is prevented to slip off the support roller 56 and the deflection roller 58, (3) Since the tape is strongly pressed by the press roller 62, the tape end is prevented from tearing off from the object, and (4) Since the support roller 56 is made of a wire coiled roller, the tape is lightly adhered to the support roller 56 at intermittent points and therefore the tape is fed smoothly.

What we claim is:

1. An automatic tape applicator for sticking an adhesive tape onto a surface of an object including a casing and a pusher, which is characterized in that:

said pusher is so mounted to the casing that it is reciprocated between uppermost and lowermost positions when it is pushed against the force of a spring urging the pusher toward the uppermost position, and when the pushing force is released from the pusher, said casing rotatably supports a disk provided with a cutting blade, said pusher is provided with a rack meshing with teeth of the disk, a tape supporter for holding a rolled adhesive tape, a tape deflection roller for deflecting the tape end downwardly, and a tape support roller for preventing the twist or sagging of the tape end fed to the underside of the deflection roller from the rolled tape, when the pusher is pushed downwardly, the tape end positioned at the underside of the deflection roller is also downwardly moved and projected from a window formed in the bottom of the casing and is stuck to the surface of the object, and the disk is rotated so as to set the cutter blade on the disk in a cutting preparatory position, and when the pushing force is released from the pusher after the sticking of the tape to the object, the disk is rotated reversely by the rack and the tape is cut at the underside of the deflection roller.

2. An automatic tape applicator as defined in claim 1 in which the tape supporter is provided with a semi-circular spring fitted in the tape supporter in compressed condition for preventing the idle rotation of the rolled tape.

3. An automatic tape applicator as defined in claim 1 in which the tape support roller is made of a coiled wire.

* * * * *